US012663017B2

(12) United States Patent
Hoeler

(10) Patent No.: US 12,663,017 B2
(45) Date of Patent: Jun. 23, 2026

(54) INFLATOR HAVING COMBINED CUTWATER AND INTAKE/EXHAUST PORT

(71) Applicant: TECHTRONIC CORDLESS GP, Anderson, SC (US)

(72) Inventor: Ryan Hoeler, Greenville, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 18/808,917

(22) Filed: Aug. 19, 2024

(65) Prior Publication Data

US 2024/0410391 A1 Dec. 12, 2024

Related U.S. Application Data

(63) Continuation of application No. 17/879,503, filed on Aug. 2, 2022, now Pat. No. 12,071,958.

(51) Int. Cl.
*F04D 29/44* (2006.01)
*F04D 17/16* (2006.01)
(Continued)

(52) U.S. Cl.
CPC ..... *F04D 29/441* (2013.01); *F04D 17/16* (2013.01); *F04D 29/4213* (2013.01); *F04D 29/624* (2013.01)

(58) Field of Classification Search
CPC ..... F04D 17/08; F04D 17/16; F04D 25/084; F04D 29/441; F04D 29/4213;
(Continued)

(56) References Cited

U.S. PATENT DOCUMENTS 5,120,193 A 6/1992 Kadle et al.
5,286,162 A 2/1994 Veres
(Continued)

FOREIGN PATENT DOCUMENTS

CN 2731153 Y 10/2005
EP 2177769 A2 4/2010
RU 2721205 C1 * 5/2020

OTHER PUBLICATIONS

English Translation of RU 2721205 (Kozhevin, May 18, 2020) (Year: 2025).*
(Continued)

*Primary Examiner* — Nathaniel E Wiehe
*Assistant Examiner* — Aye S Htay
(74) *Attorney, Agent, or Firm* — Michael Best & Friedrich LLP

(57) ABSTRACT

A tool to generate airflow including a housing that has an intake port and an outlet port, and an impeller coupled to the housing. The housing at least partially defines a volute between the intake port and the outlet port, and the impeller is in airflow communication with the volute to generate an airflow between the intake port and the outlet port through the volute. The tool includes an airflow guide that is disposed in the housing and that has an air intake portion with a volute wall partially defining the volute and disposed in close proximity to the impeller. The air intake portion defines the intake port and a passageway extends from the intake port toward the impeller along an airflow axis.

17 Claims, 13 Drawing Sheets

(51) Int. Cl.
*F04D 29/42* (2006.01)
*F04D 29/62* (2006.01)

(58) Field of Classification Search
CPC ..... F04D 29/624; F04D 29/422; F04D 29/28; F04D 29/30; F04D 29/4206
See application file for complete search history.

(56) References Cited

U.S. PATENT DOCUMENTS 6,045,341 A * 4/2000 Mak ..... A63H 33/40 446/179
6,155,781 A * 12/2000 Tsai ..... F04D 25/084 416/185
6,821,088 B2 11/2004 Sakai et al.
6,955,529 B2 * 10/2005 Tsai ..... F04D 25/084 417/423.15
7,284,968 B2 10/2007 Tsai
8,083,477 B2 12/2011 Hwang et al.
8,678,131 B2 3/2014 Wiegers et al.
10,837,451 B2 11/2020 Yakubova et al.
2006/0099071 A1 5/2006 Kao et al.
2006/0198741 A1 * 9/2006 Wu ..... F04D 25/084 417/406
2007/0014666 A1 1/2007 White
2010/0068047 A1 3/2010 Hwang et al.
2010/0092282 A1 4/2010 Hwang et al.
2015/0198178 A1 7/2015 Kawasaki
2018/0187687 A1 * 7/2018 Yakubova ..... F04D 25/08
2018/0209440 A1 7/2018 Kono et al.
2019/0338784 A1 11/2019 Chen et al.
2021/0033104 A1 * 2/2021 Teramoto ..... F04D 29/422

OTHER PUBLICATIONS

Partial European Search Report for Application No. 23187076.7 dated Dec. 14, 2023 (13 pages).

* cited by examiner

INFLATOR HAVING COMBINED CUTWATER AND INTAKE/EXHAUST PORT

CROSS-REFERENCE TO RELATED APPLICATION

This application is a continuation of U.S. patent application Ser. No. 17/879,503, filed Aug. 2, 2022, and now U.S. Pat. No. 12,071,958, the entire contents of which are incorporated by reference in their entirety.

TECHNICAL FIELD

The present disclosure relates to an inflator tool, and more particularly to a monolithic deflation port and cutwater.

BACKGROUND

An inflator tool creates a high velocity airflow by pulling air into the volute of a tool housing by an impeller coupled to rotate with the output of a motor and directing the airflow out of the tool through an outlet. Various portions of the inflator tool affect the flow behavior, i.e., aerodynamic efficiency, performance, and acoustics, of the airflow through the inflator. At least two components of an inflator that affect the flow behavior are the deflation port and the cutwater. The geometry of the deflation port affects the airflow to the impeller. The cutwater separates rotational flow of air near the impeller and directs the flow toward the outlet.

SUMMARY OF THE DISCLOSURE

The present disclosure provides, in one aspect, an inflator including a housing, an impeller, and an airflow guide. The housing includes an intake port and an outlet port. A volute is defined between the first and outlet ports. The impeller is coupled to the housing. The impeller is in airflow communication with the volute and generates an airflow through the volute. The airflow guide is disposed in the housing and includes an air intake portion and a cutwater that is monolithically formed with the air intake portion. The air intake portion is disposed flush with a portion of the volute and defines the intake port. The air intake portion also defines a passageway extending from the intake port along an airflow axis. The cutwater extends from the air intake portion and is disposed between the passageway and the outlet port, adjacent a circumferential edge of the impeller.

The present disclosure provides, in another aspect, an inflator including a housing, an impeller, and an airflow guide. The housing includes an inlet defined in the top surface of the housing, and an outlet that is spaced from the inlet. The impeller is rotatably supported in the housing and is configured to draw air into the housing through the inlet. The airflow guide is supported in the housing adjacent the impeller. The airflow guide includes a deflator portion. The deflator portion has a port inlet having an inlet diameter, and a port outlet having an outlet diameter. A channel is defined between the port inlet and the port outlet. The port inlet is positioned generally flush with the top surface of the housing. The outlet diameter is smaller than the inlet diameter.

The present disclosure provides, in another aspect, an inflator including a housing, an impeller, and an airflow guide. The housing includes an intake port and an outlet port. A volute is defined between the first and outlet ports. The impeller is rotatably supported in the housing and is in airflow communicate with the volute. The impeller generates an airflow through the volute. The airflow guide is supported in the housing adjacent the impeller and includes a cutwater and an air intake portion. The air intake portion has a wall defining a passageway extending along an axis from the intake port to the impeller. The passageway has an arcuate profile in cross-section along the axis.

The present disclosure provides, in another aspect, an airflow guide for an inflator tool that has an intake port and an outlet port. The airflow guide includes an air intake portion and a cutwater extending from the air intake portion. The air intake portion is shaped to direct an airflow relative to the intake port. The cutwater is monolithically formed with the air intake portion and is configured to guide the airflow toward the outlet port.

Other features and aspects of the embodiments will become apparent by consideration of the following detailed description and accompanying drawings.

Before any exemplary embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
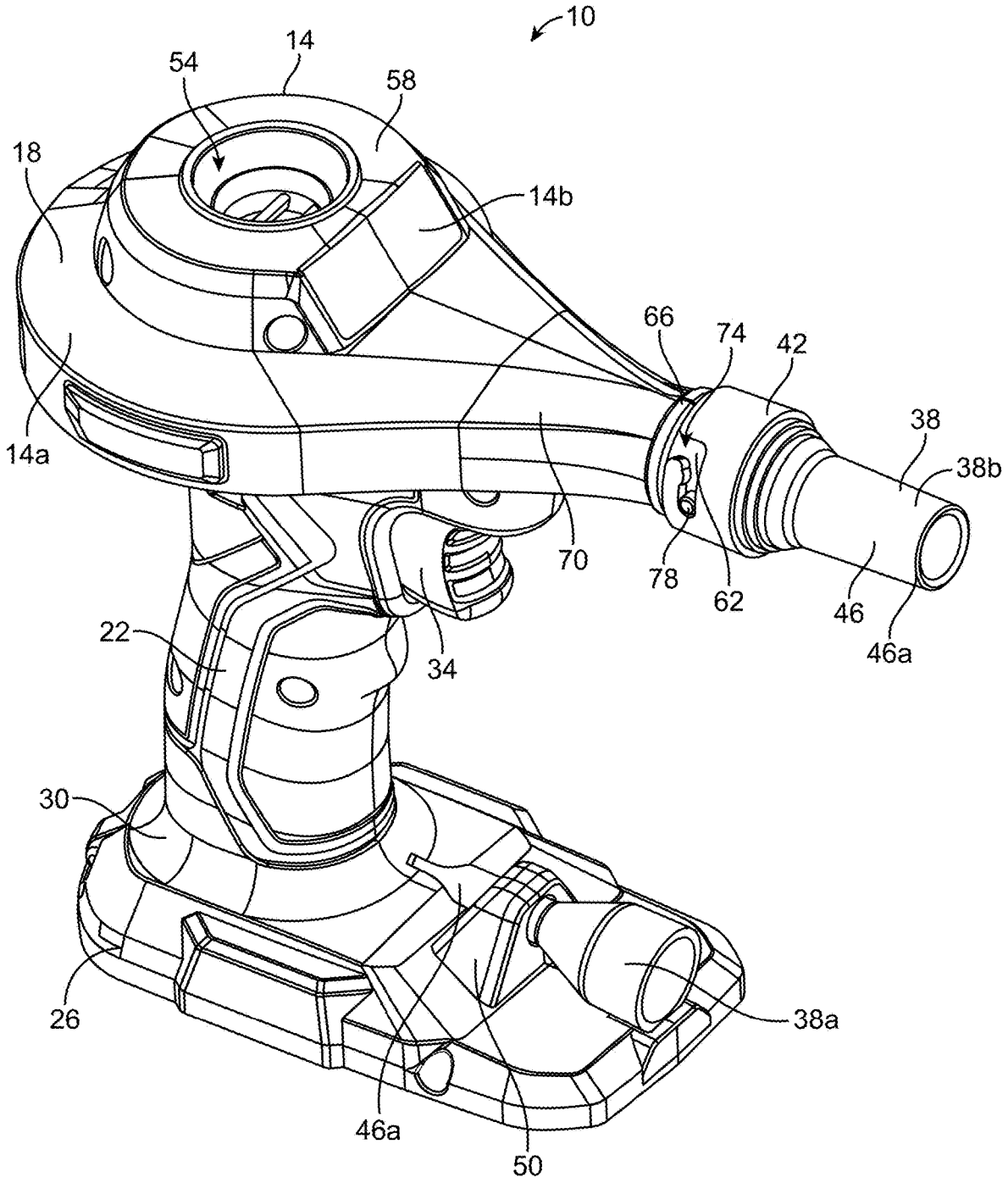
FIG. 1 is a perspective view illustrating an inflator according to the present disclosure.

FIG. 1 illustrates a tool 10 (i.e., an inflator) according to the present disclosure. The inflator 10 includes a housing 14 that has an air intake portion 18, a handle 22 extending from the air intake portion 18, and a battery connection portion 26 at a distal end 30 of the handle 22. The housing 14 may be formed a first clamshell half 14*a* coupled to a second clamshell half 14*b* (e.g., via fasteners, clips, or other fasteners, including adhesive). A battery pack (not shown) can be removably coupled to the battery connection portion 26 to provide electrical power for the inflator 10. A trigger 34 is supported on the handle 22 (e.g., below the air intake portion 18 as shown in FIG. 1).

A nozzle 38 may be coupled to the inflator 10 and includes a coupling portion 42 and defines an air passageway 46 extending from the coupling portion 42. Nozzles with different profiles or outlet sizes may be coupled to the inflator 10. The housing 14 includes a nozzle storage location 50 extending from the battery connection portion 26 that facilitates storage of the nozzle 38 or another nozzle (e.g., a nozzle 38*a*) on the housing 14. The nozzle 38 may be used for deflation or inflation of an inflatable object.

Figure 2:
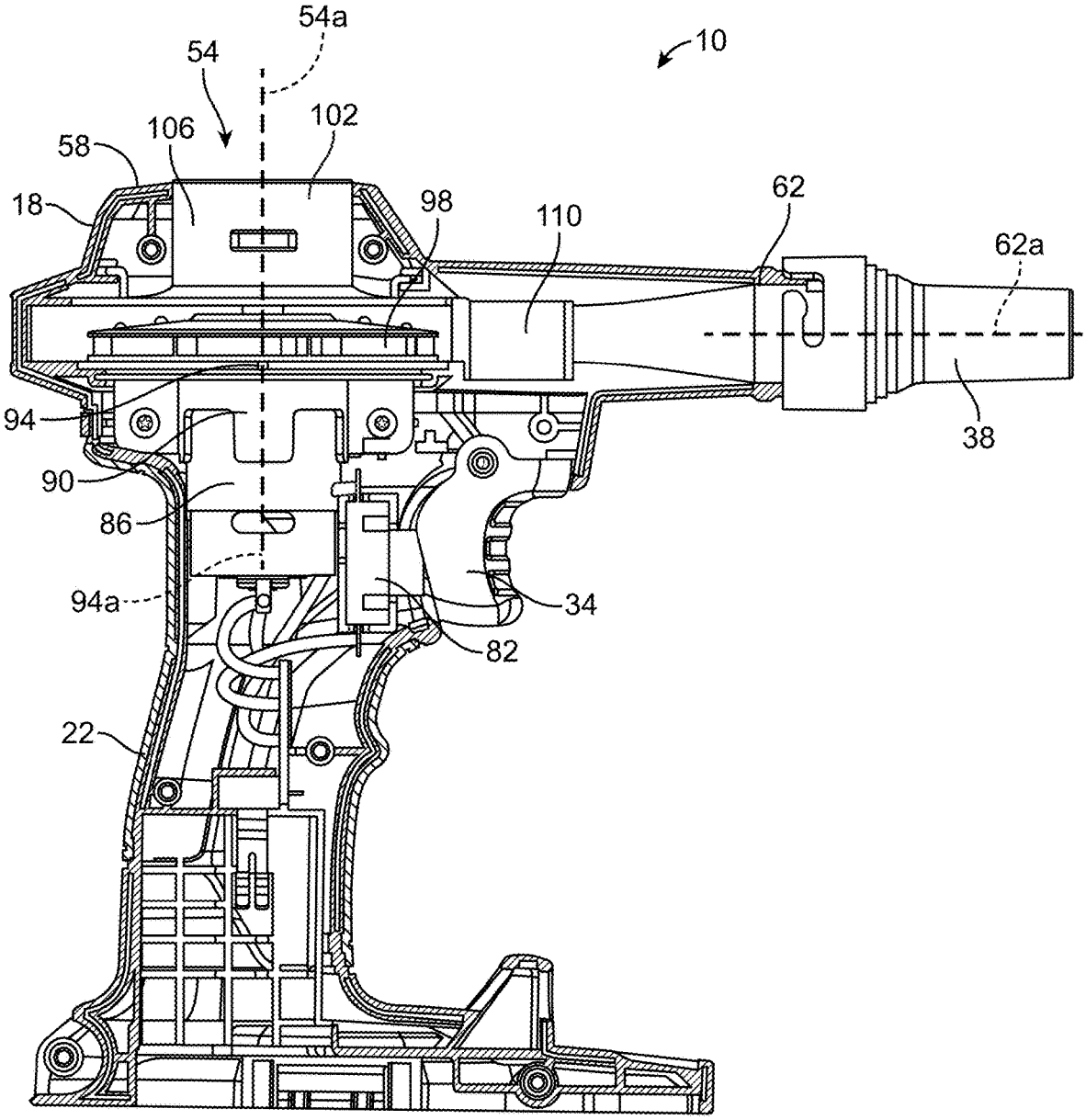
FIG. 2 is a section view illustrating the inflator according to FIG. 1.

The housing 14 has an intake port 54 and an outlet port 62. As shown in FIG. 2, the intake port 54 is flush or substantially flush (e.g., defining a small lip) with a top surface 58 of the housing and is defined by the air intake portion 18, and the intake port 54 has an intake port axis 54*a* and the outlet port 62 has an outlet port axis 62*a*. The intake port axis 54*a* is disposed at an angle relative to the outlet port axis 62*a* (e.g., a 90-degree angle). Returning to FIG. 1, the nozzle 38 can be coupled to the outlet port 62 (e.g., to facilitate inflation of an inflatable object). The nozzle 38 includes a track 74 that receives a node 78 that extends from the outlet port 62. The nozzle 38 is inserted onto the outlet port 62 with the node 78 received in the track 74. The nozzle 38 is then rotated relative to the outlet port 62 to secure the nozzle 38 to the outlet port 62.

With reference to FIG. 2, a switch 82 is supported in the handle 22 adjacent the air intake portion 18. The trigger 34 engages the switch 82, which is configured to activate the inflator 10. The trigger 34 is pivotally coupled to the handle 22. A motor 86 is supported in the handle 22 of the housing 14 adjacent the air intake portion 18. The motor 86 is coupled to a motor mount 90 that is coupled to the housing 14. The motor 86 includes an output shaft 94 that extends from the motor 86. The output shaft 94 rotates about a motor axis 94*a*. An impeller 98 is coupled to the output shaft 94 and rotates with the output shaft 94. The impeller 98 is disposed in the air intake portion 18. An airflow guide 102 is coupled to the housing 14 in the air intake portion 18 adjacent to the impeller 98.

Figure 3:
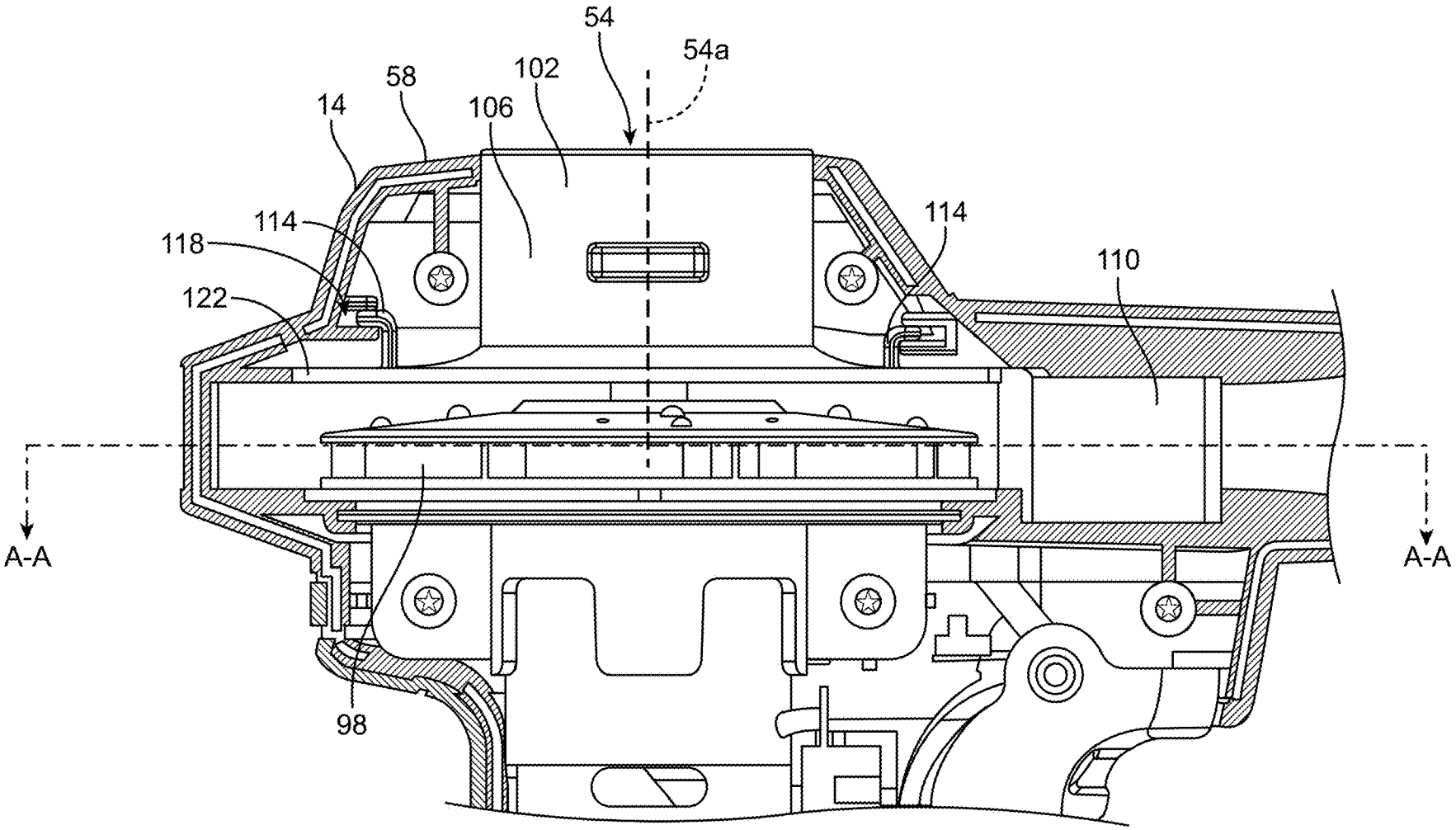
FIG. 3 is an enlarged view illustrating the airflow guide, and impeller according to FIG. 1

With reference to FIG. 3, the airflow guide 102 includes an air intake portion 106 and a cutwater 110 that extends from and is monolithically formed with the air intake portion 106. That is, the air intake portion 106 and the cutwater 110 may be co-molded or otherwise formed as a single piece. The airflow guide 102 is coupled to the housing 14 by mounting tabs 114 that extend from the airflow guide 102 and that are partially disposed in mounting pockets 118 formed in each of the clamshell halves 14*a*, 14*b* of the housing 14. The illustrated mounting tabs 114 are generally L-shaped. The illustrated airflow guide 102 includes two mounting tabs 114 although other quantities and configurations may be included. As shown, the air intake portion 106 includes a volute wall 122 and the mounting tabs 114 extend from the volute wall 122.

Figure 4:
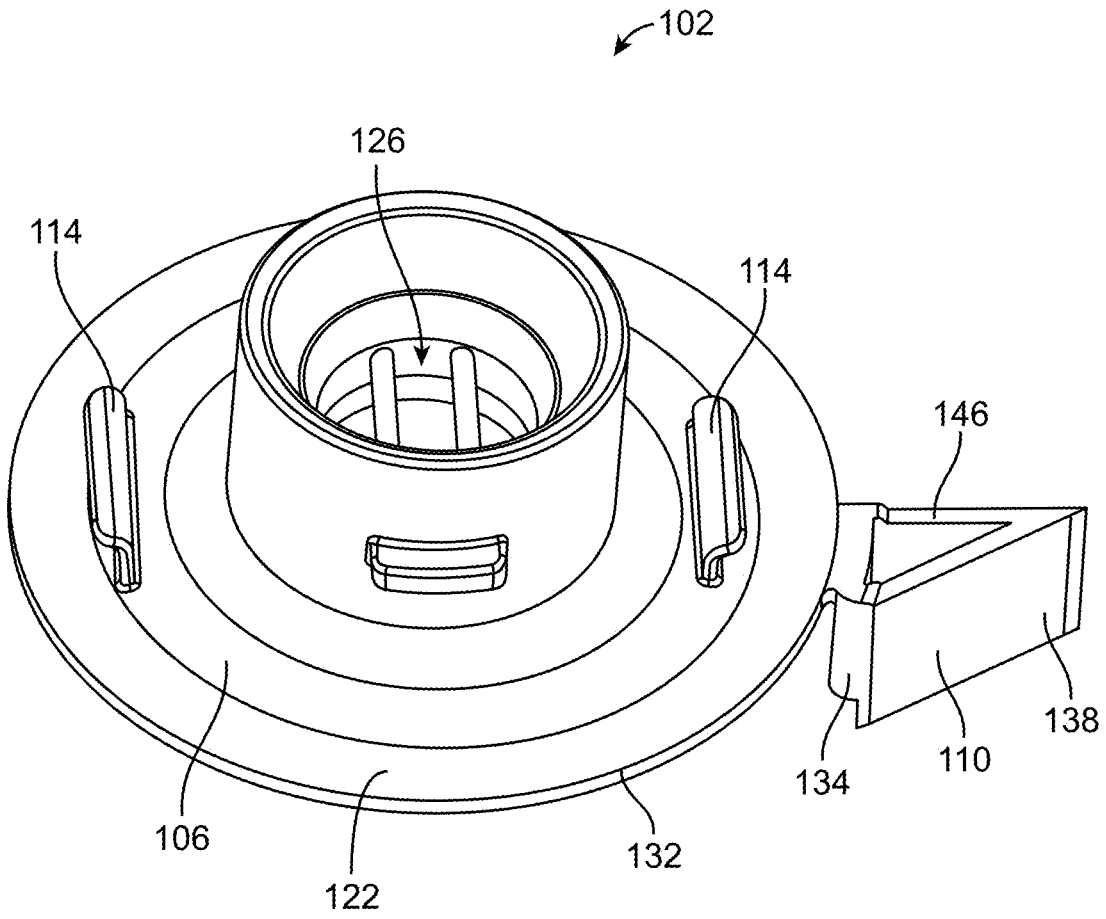
FIG. 4 is a perspective view illustrating the airflow guide of FIG. 1.

The volute wall 122 is positioned in the air intake portion 18 and is disposed in close proximity to the impeller 98. As shown in FIGS. 3 and 4, a passageway 126 is defined by an upper portion of the air intake portion 106 and extends from the volute wall 122 (e.g., in arcuate fashion) toward the intake port 54 in a first direction parallel to the intake port axis 54*a*. The passageway 126 defines the intake port 54 opposite the volute wall 122.

Figure 5:
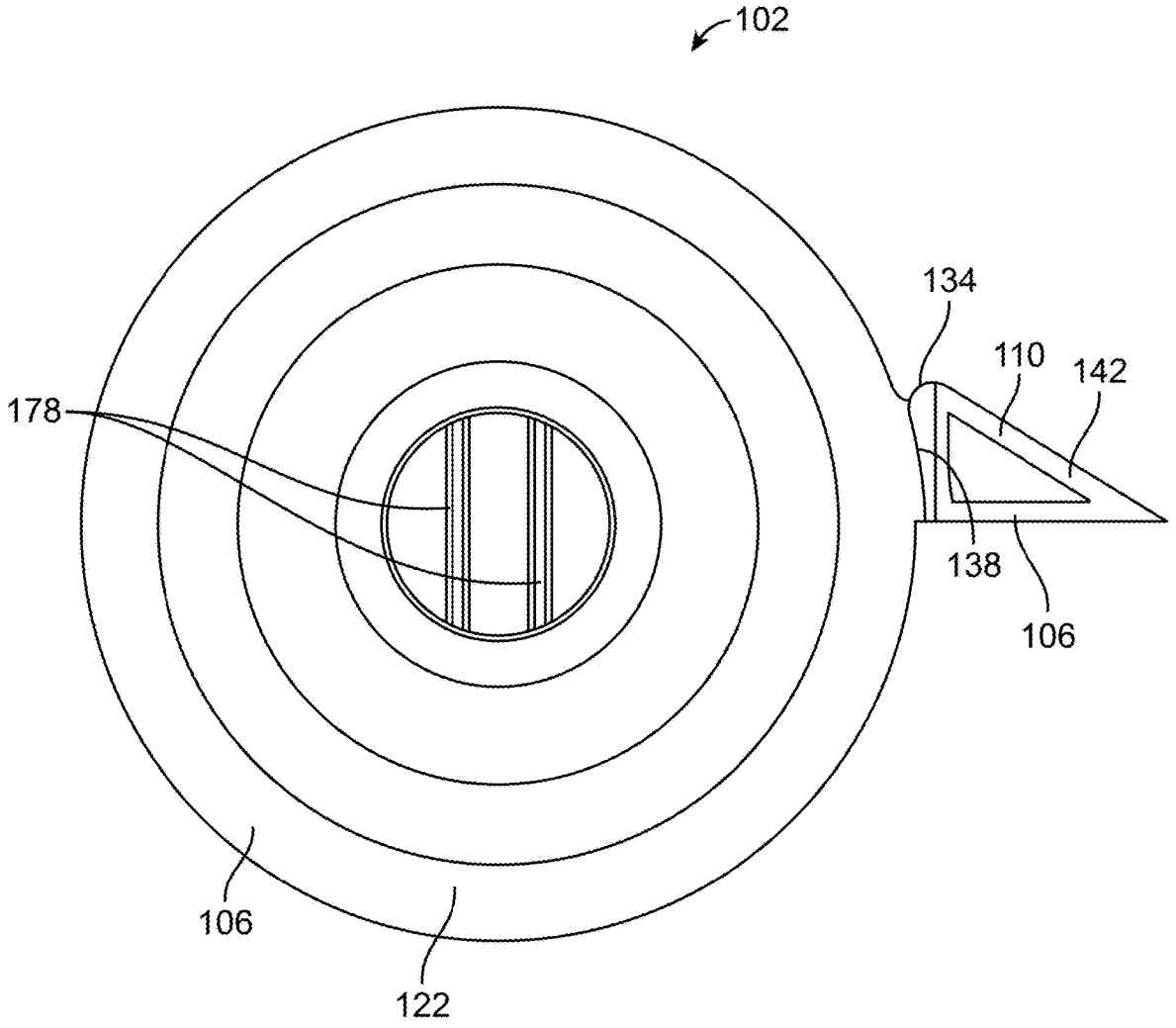
FIG. 5 is a bottom view illustrating the airflow guide according to FIG. 1.

With reference to FIGS. 4 and 5, the cutwater 110 extends from an edge 132 of the volute wall 122 in a second direction opposite the first direction. The cutwater 110 has a rounded edge 134. A volute face 138 and an exhaust face 142 extend from the rounded edge 134 and the volute face 138 and the exhaust face 142 are arranged relative to each other at an acute angle. The volute face 138 has an arcuate profile. As shown, the cutwater 110 has a generally triangular cross-section with a third face 146 that couples to the volute face 138 and the exhaust face 142.

Figure 6:
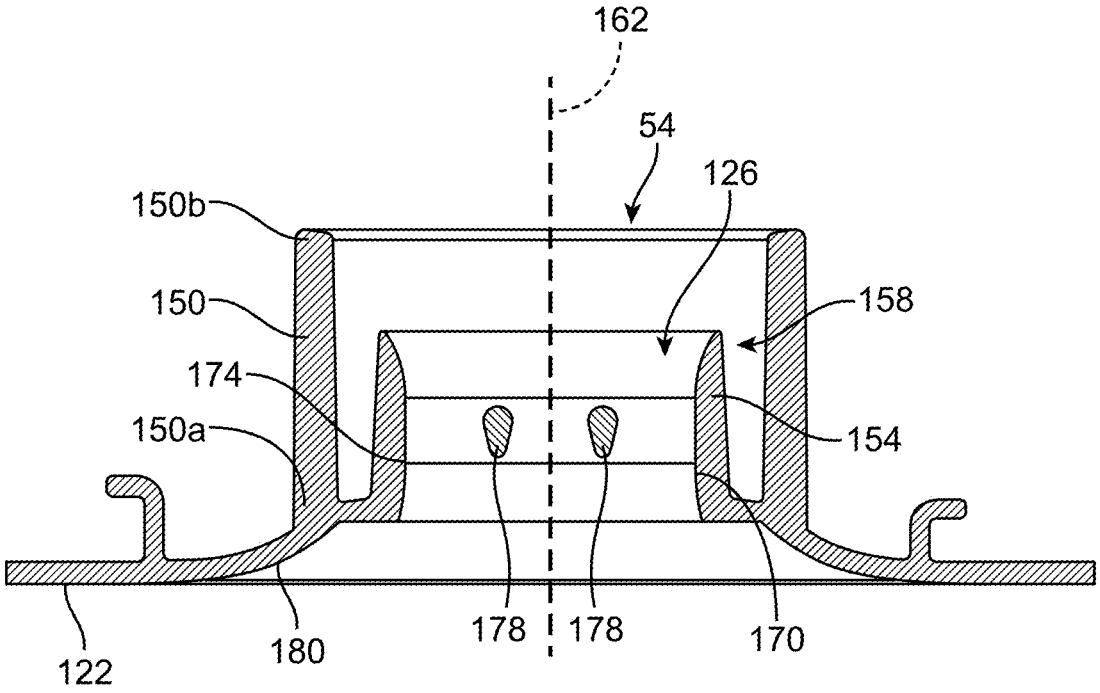
FIG. 6 is a section view of the deflator portion of the airflow guide according to FIG. 1.
Figure 7:
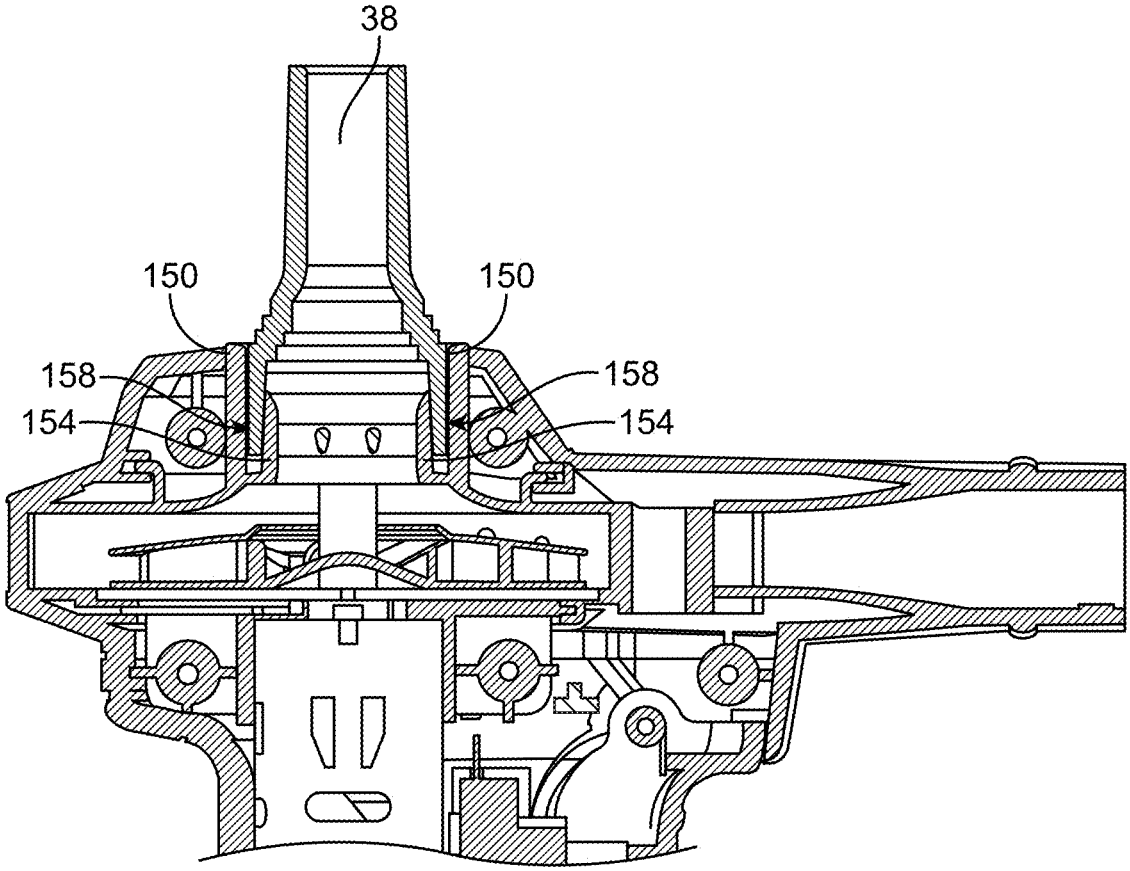
FIG. 7 is a section view illustrating the inflator according to FIG. 1, including a nozzle coupled to the inflator.

With reference to FIGS. 5 and 6, the passageway 126 is partially defined by an outer wall 150 and by an inner wall 154 that is coupled or joined to the outer wall 150 at a lower annular portion. The outer wall 150 has a first end 150*a* at which the outer wall 150 joins the volute wall 122, and a second end 150*b* opposite the first end 150*a*. The second end 150*b* is flush or substantially flush with the top surface 58 of the housing 14. The inner wall 154 extends radially inward from the first end 150*a* of the outer wall 150 and upward toward the second end 150*b*. Each of the illustrated outer wall 150 and the inner wall 154 are substantially cylindrical and an annular gap 158 is defined between the outer and inner walls 150, 154. The passageway 126 extends along an airflow axis 162. As shown in FIG. 6, the inner wall 154 is arcuate in cross-section taken along the airflow axis 162 and has an inner surface 170 with a convex profile such that a central section 174 of the inner wall 154 is thicker than ends of the inner wall 154 (e.g., the inner wall 154 has a bell shape in cross-section). One or more ribs 178 (e.g., two ribs 178) extend across the passageway 126 between different portions of the inner wall 154. The illustrated ribs 178 have an inverted teardrop shape in cross-section, although the ribs 178 may have other cross-sectional shapes. As shown, the inflator 10 includes two ribs 178 that are spaced from each other to prevent ingress of larger objects, such as the finger of a user. The volute wall 122 has a transition 180 that defines an arcuate profile adjacent the first end 150*a* of the outer wall 150 to transition between the volute wall 122 and the inner wall 154. With reference to FIG. 7, the nozzle 38 may be coupled to the intake port 54 to facilitate deflating an inflatable object. When the nozzle 38 is coupled to the intake port 54, the coupling portion 42 of the nozzle 38 is disposed in the gap 158.

Figure 8:
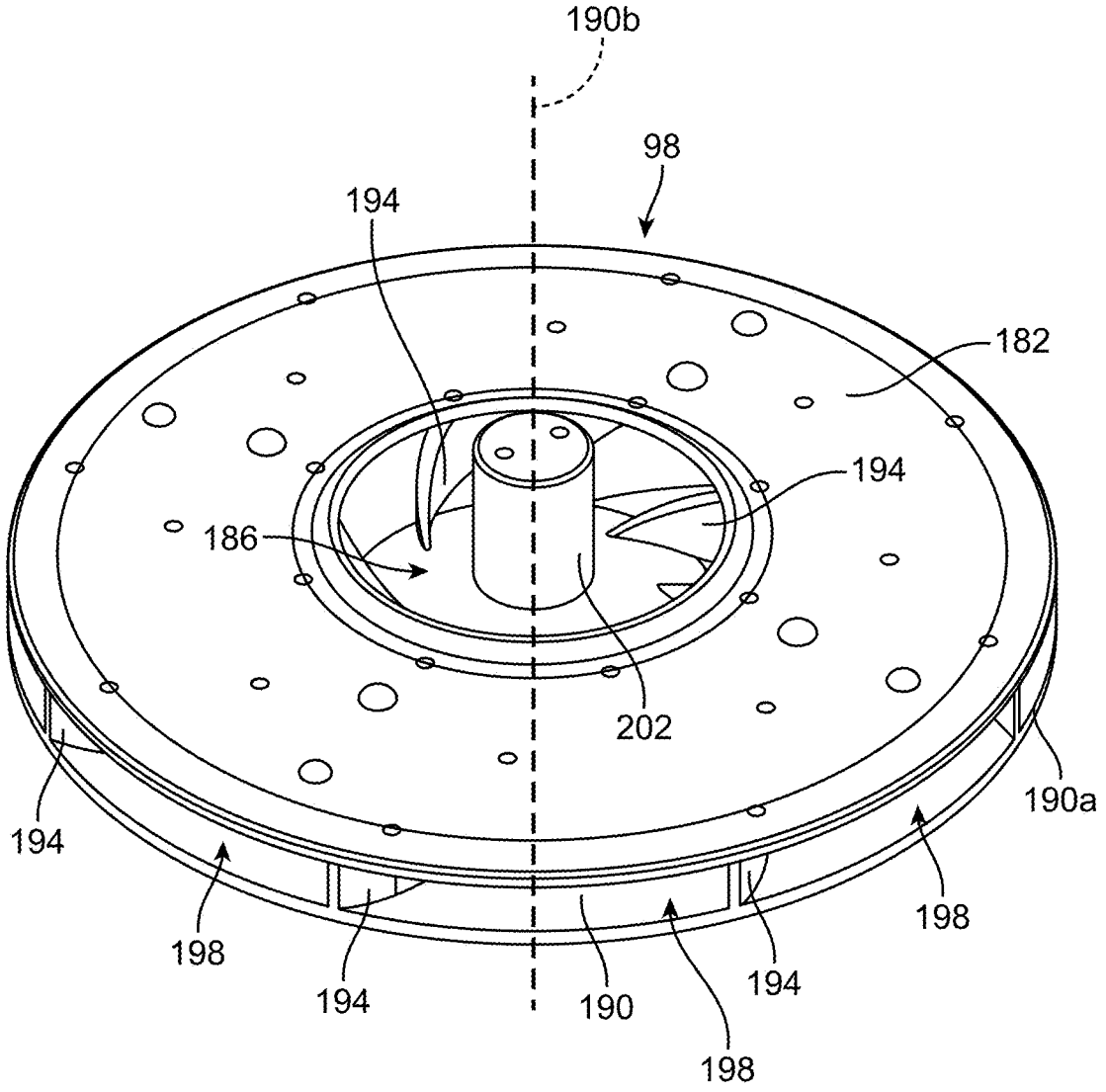
FIG. 8 is a perspective view illustrating the impeller according to FIG. 1.
Figure 9:
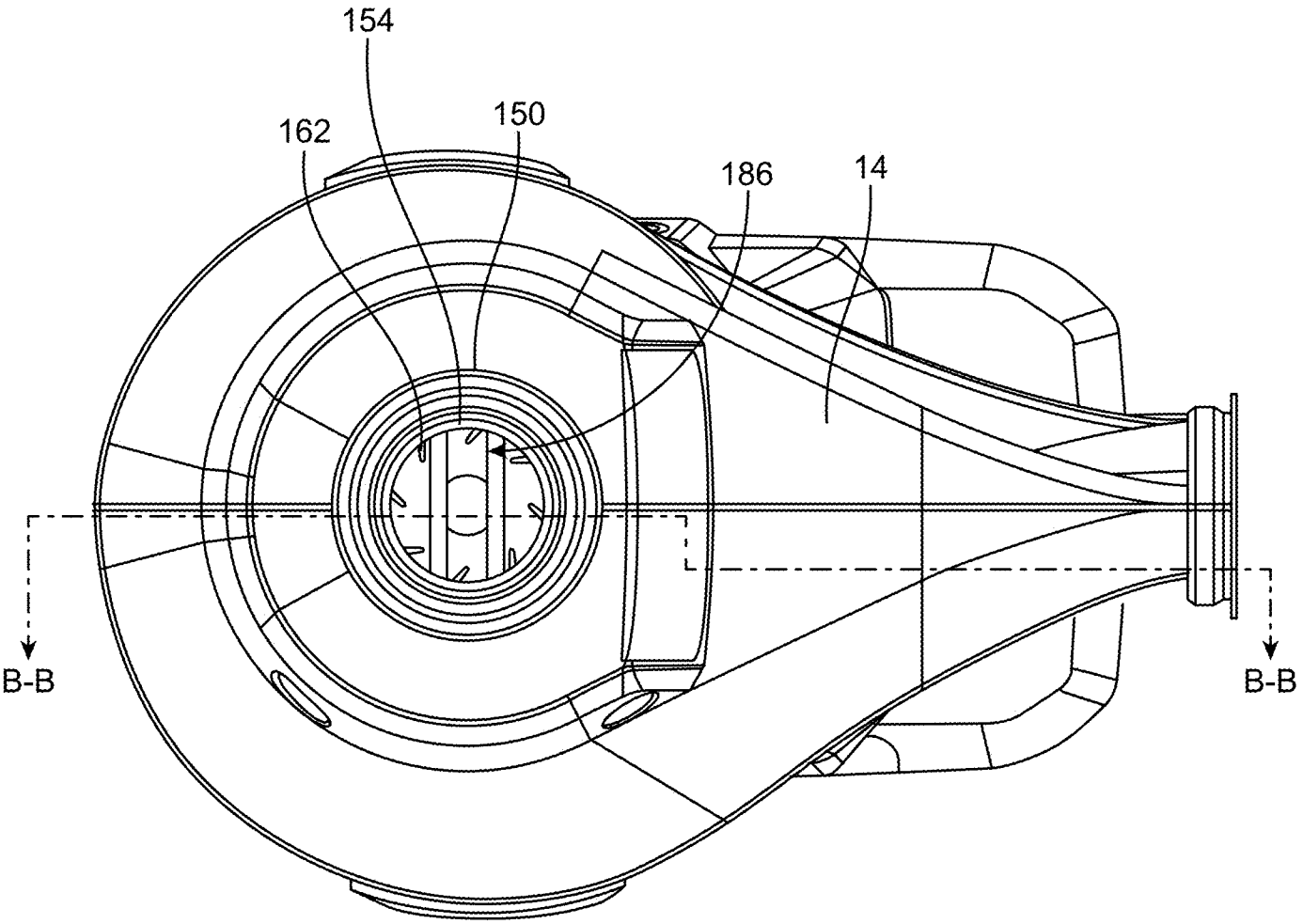
FIG. 9 is a top view illustrating the inflator according to FIG. 1.
Figure 10:
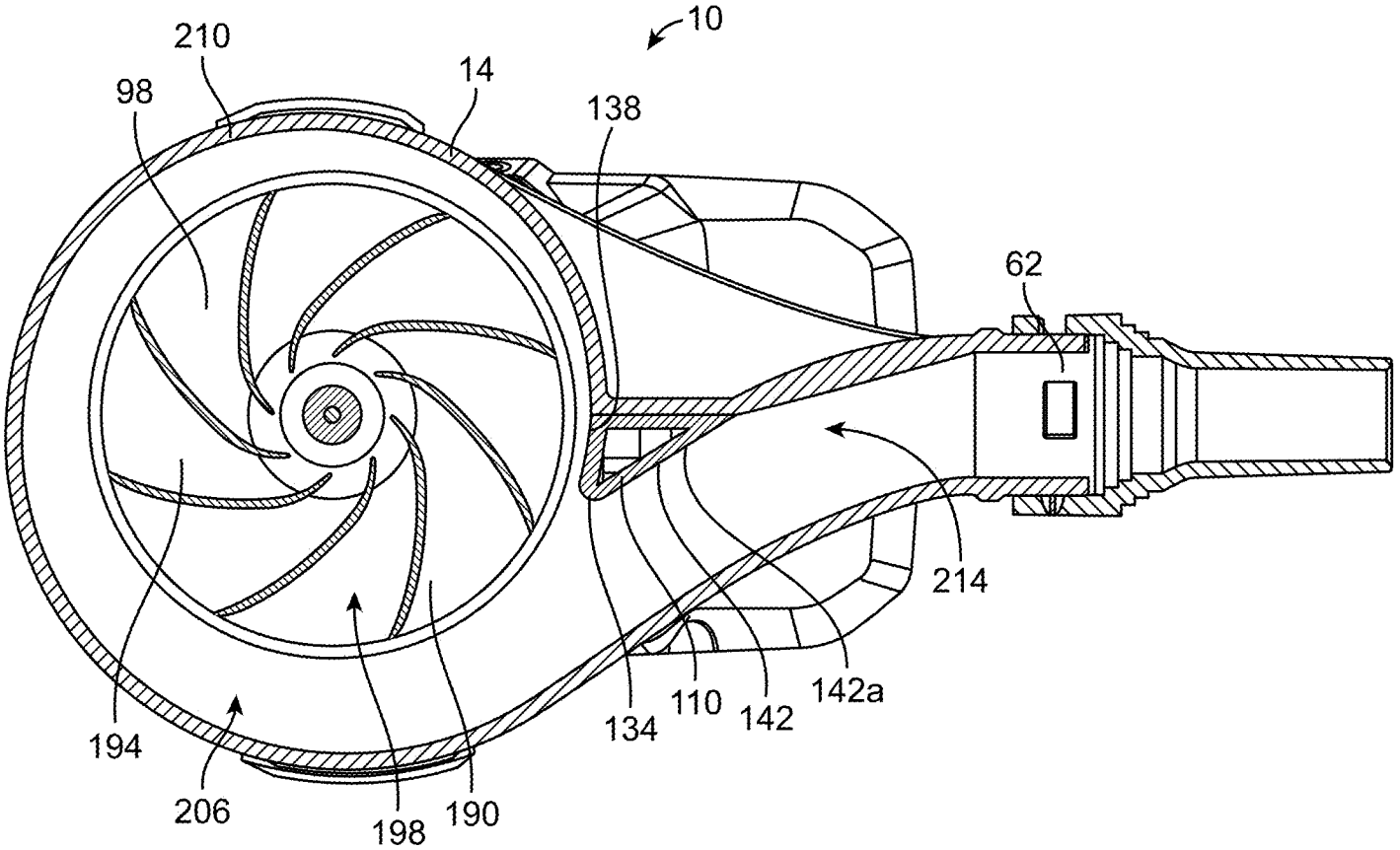
FIG. 10 is a section view illustrating the volute, impeller, and volute according to FIG. 4.

FIG. 8 illustrates the impeller 98 that has a first plate 182 (e.g., substantially circular) and that defines an impeller airflow opening 186, and a second plate 190 and a plurality of blades 194 that extend between the first plate 182 and the second plate 190. The first and second plates 182, 190 define circumferential edges and are rotatable with the blades 194 about an impeller axis 190*b*. The impeller 98 is rotatably supported in the housing 14 and the impeller axis 190*b* is axially aligned, or coaxial, with the airflow axis 162 (shown in FIGS. 6 and 11). Adjacent blades 194 define impeller channels 198, and the impeller 98 includes a hub 202 that is coupled to the output shaft 94 (e.g., by press-fit connection). With reference to FIGS. 8 and 10, the blades 194 have an arcuate profile and extend from adjacent the hub 202 to the circumferential edges of the first and second plates 182, 190. The impeller 98 is positioned in the housing 14 such that the circumferential edge is adjacent the volute face 138 of the cutwater 110.

Figure 11:
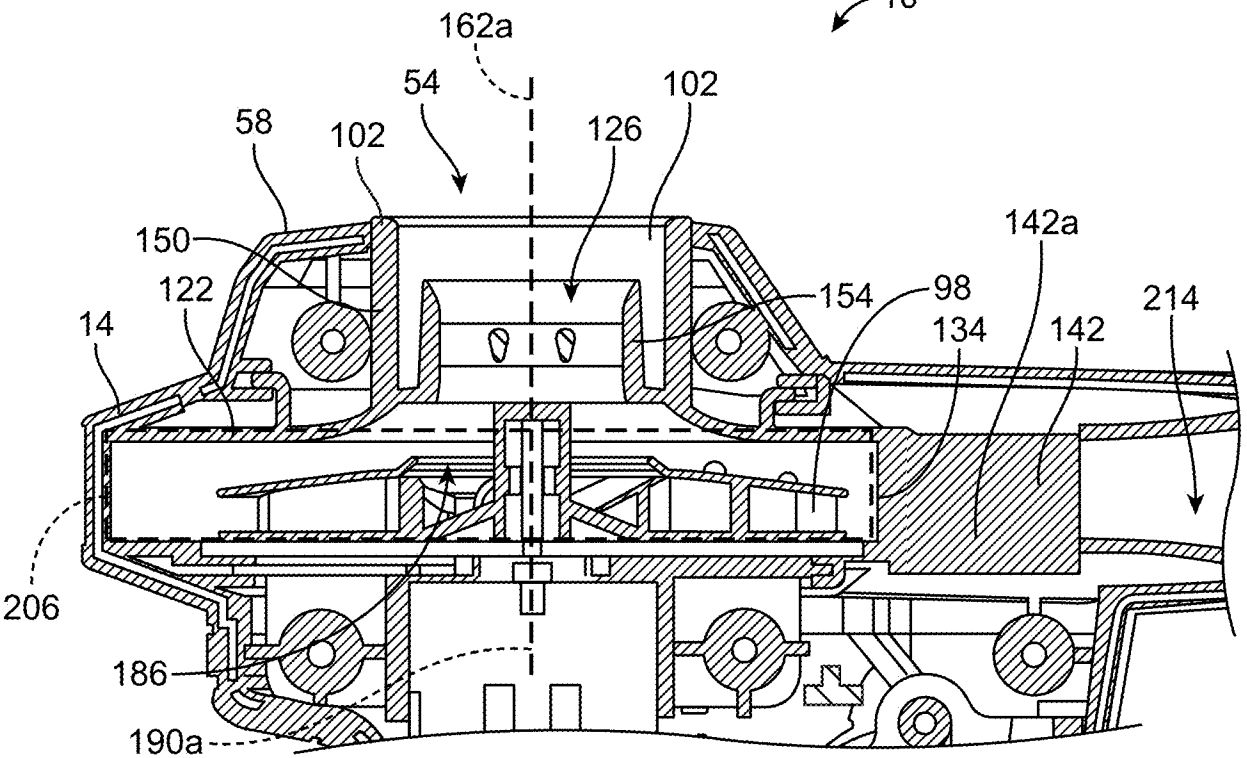
FIG. 11 is a section view illustrating the airflow guide and impeller according to FIG. 9.

With reference to FIGS. 10 and 11, the housing 14, the volute wall 122 of the air intake portion 106, and the cutwater 110 define a volute 206 between the intake port 54 and the outlet port 62. The impeller 98 is fluidly coupled to the volute 206 and the volute wall 122 is disposed flush with a portion of the volute 206 (e.g., an upper side of the volute 206 when viewed in FIG. 11) A distance between the circumferential edges of the first and second plates 182, 190 and the outer surface of the volute 206 (defined by an inner surface 210 of the housing 14) increases as the impeller 98 rotates in a counter-clockwise direction (as viewed in FIG. 10). An airflow channel 214 is in communication with the outlet port 62 and the volute 206 to distribute air to the outlet port 62. The exhaust face 142 of the cutwater 110 defines a guide surface 142*a* that partially defines the airflow channel 214. More specifically, the exhaust face 142 is positioned between the passageway 126 and the outlet port 62, and the exhaust face 142 extends from the rounded edge 134 and the volute wall 122 in a second direction relative to the first direction of the airflow axis 162. The rounded edge 134 defines an airflow separation location.

Figure 12:
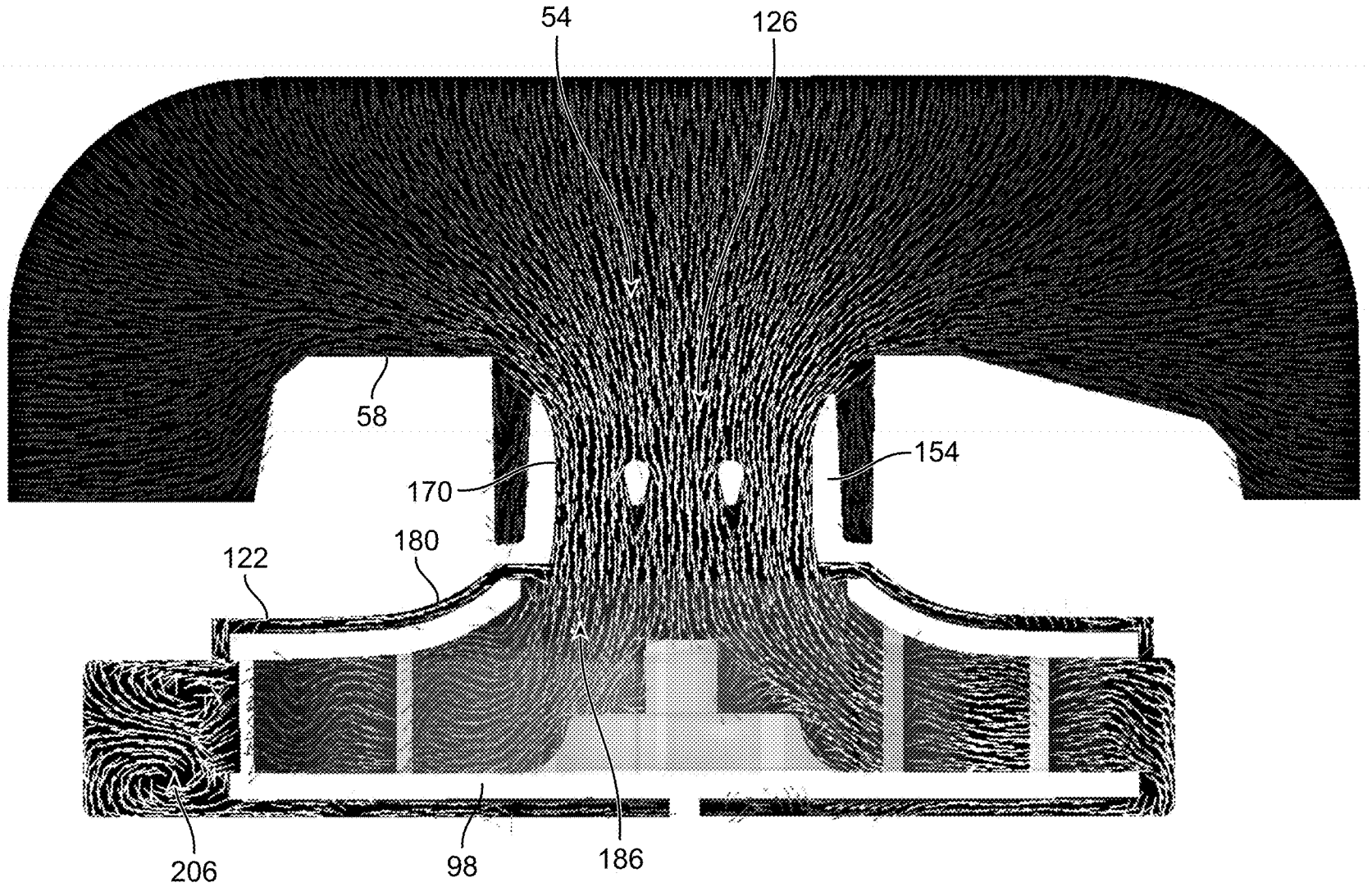
FIG. 12 is a side section view illustrating an airflow path of the inflator according to FIG. 1.
Figure 13:
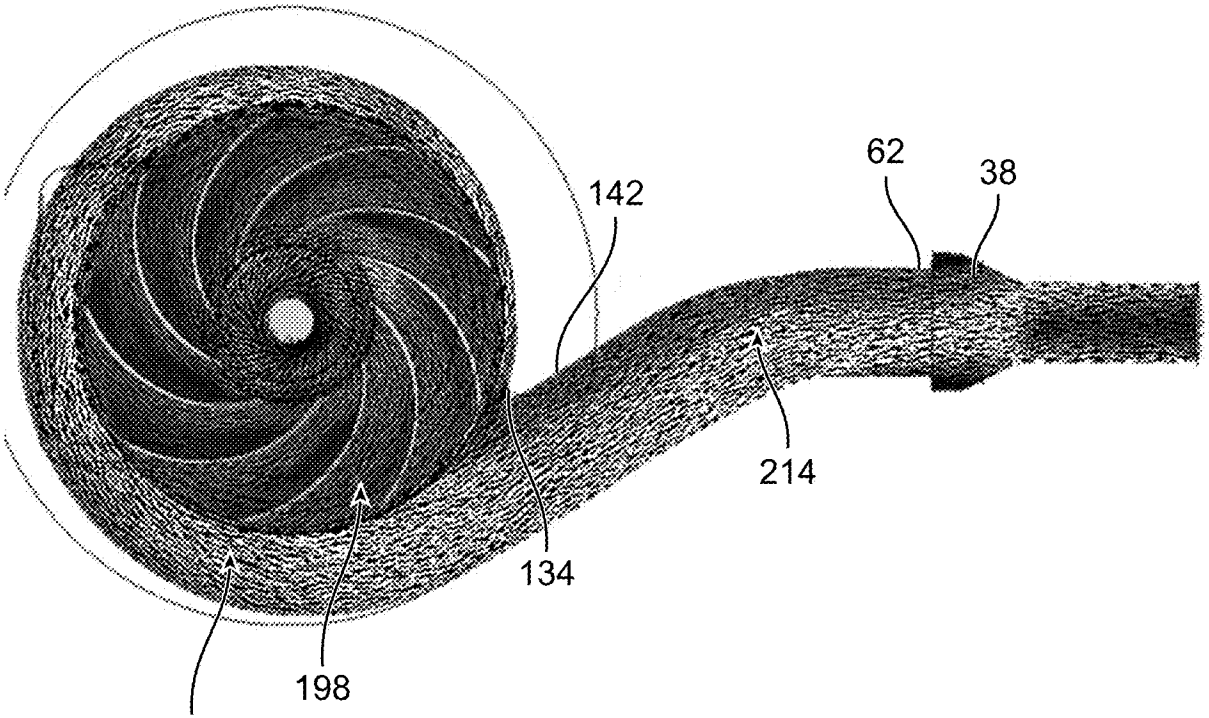
FIG. 13 is a top section view illustrating an airflow path of the inflator according to FIG. 1.

With reference to FIG. 12, the intake port 54 receives airflow through the intake port 54 generated by rotation of the impeller 98. The air intake portion 106 of the airflow guide 102 is shaped to direct airflow from the intake port 54 to the impeller 98, which distributes the airflow into the volute 206. The flush nature between the intake port 54 and the top surface 58 of the housing 14 reduces disruption of the airflow as the airflow enters the passageway 126. The arcuate-shaped inner surface 170 of the inner wall 154 concentrates the airflow as the airflow flows through the passageway 126. That is, the passageway 126 streamlines the incoming airflow into the inflator 10. The airflow enters the impeller airflow opening 186 by flowing along the volute wall 122 via the transition 180. With reference to FIG. 13, the airflow is directed through the impeller channels 198 and exits the impeller channels 198 adjacent the circumferential edges of the first and second plates 182, 190. The airflow then flows through the volute 206. As the airflow reaches the cutwater 110, the rounded edge 134 separates the airflow from the volute 206. The separated airflow is guided through the airflow channel 214 by the exhaust face 142 and to the outlet port 62 of the housing 14. The cutwater 110 maintains a smooth airflow through the volute 206 and limits turbulence and recirculation of the airflow in the airflow channel 214, thereby attenuating sound of the airflow. A nozzle (e.g., the nozzle 38) may be coupled to the intake port 54 to facilitate deflation of an inflatable object, or a nozzle (e.g., the nozzle 38) may be coupled to the outlet port 62 to facilitate inflation of an inflatable object.

While the above example may be described in connection with an inflator tool with monolithic deflation port and cutwater structure, the deflation port and cutwater structure described herein may be applicable to other types of tools. Moreover, embodiments and limitations disclosed herein are not dedicated to the public under the doctrine of dedication if the embodiments an/or limitations: (1) are not expressly claimed in the claims; and (2) are or are potentially equivalents of express elements and/or limitations in the claims under the doctrine of equivalents.

Various features of the invention are set forth in the following claims.

The invention claimed is:

1. A tool to generate airflow, the tool comprising:

a housing including an intake port and an outlet port and partially defining a volute between the intake port and the outlet port;

an impeller coupled to the housing and in airflow communication with the volute to generate an airflow between the intake port and the outlet port through the volute; and an airflow guide disposed in the housing and including an air intake portion having a volute wall separate from the housing, the volute wall partially defining the volute with the housing and disposed adjacent to the impeller, the air intake portion defining the intake port and a passageway extending from the intake port toward the impeller along an airflow axis.

2. The tool of claim 1, wherein the impeller is disposed in the air intake portion and the volute wall is disposed flush with an upper side of the volute.

3. The tool of claim 1, wherein the impeller is rotatable about an impeller axis that is coaxial with the airflow axis.

4. The tool of claim 1, wherein the passageway is at least partially defined by an inner wall, and wherein the volute wall includes a transition extending from the inner wall and defined by a curved profile.

5. The tool of claim 4, wherein the passageway is partially defined by an inner wall extending along the airflow axis, and wherein the transition extends from the inner wall to the volute to guide an airflow to an impeller airflow opening.

6. The tool of claim 4, wherein the passageway is partially defined by an outer wall disposed radially outward of the inner wall, and wherein the inner wall is coupled to the outer wall at a lower annular portion of the air intake portion, wherein the lower annular portion is disposed closer to the volute wall than an opening to the intake port along the airflow axis.

7. The tool of claim 1, wherein the intake port is substantially flush with a top surface of the housing to reduce disruption of an airflow as the airflow enters the passageway.

8. The tool of claim 1, wherein the passageway extends in a first direction between the intake port and the volute wall, and wherein the air intake portion is shaped to direct an airflow from the intake port to the impeller in a second direction different from the first direction.

9. The tool of claim 1, further comprising a cutwater extending from the volute wall.

10. A tool to generate airflow, the tool comprising:

a housing including an intake port and an outlet port and at least partially defining a volute between the intake port and the outlet port, the intake port having an outer wall and an inner wall spaced radially inward from the outer wall by a gap;

an impeller coupled to the housing and in airflow communication with the volute to generate an airflow between the intake port and the outlet port through the volute; and an airflow guide disposed in the housing and including an air intake portion at least partially defining the intake port and having a passageway extending from the intake port along an airflow axis, the passageway at least partially defined by an inner surface of the inner wall, wherein the inner surface has a curved profile.

11. The tool of claim 10, wherein the curved profile is convex relative to the airflow axis.

12. The tool of claim 10, wherein the air intake portion has a volute wall disposed flush with an upper side of the volute.

13. The tool of claim 12, wherein the volute wall includes a transition extending from the inner wall and defined by a curved profile.

14. The tool of claim 13, wherein the transition is formed as part of the inner wall.

15. The tool of claim 13, wherein the inner wall extends along the airflow axis, and wherein the transition extends from the inner wall to the volute to guide an airflow to an impeller airflow opening.

16. The tool of claim 10, further comprising a cutwater extending from the airflow guide and formed with the air intake portion.

17. The tool of claim 10, wherein the gap is configured to receive a coupling portion of a nozzle.

* * * * *